US010306950B2

(12) United States Patent
Paik et al.

(10) Patent No.: US 10,306,950 B2
(45) Date of Patent: Jun. 4, 2019

(54) STRAP CONNECTION MEMBER

(71) Applicant: WOOJIN PLASTIC CO., LTD, Guri-si, Gyeonggi-do (KR)

(72) Inventors: Jisook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Guri-si (KR)

( * ) Notice: Subject to any disclaimer, the term of this patent is extended or adjusted under 35 U.S.C. 154(b) by 112 days.

(21) Appl. No.: 15/472,805

(22) Filed: Mar. 29, 2017

(65) Prior Publication Data

US 2018/0213891 A1 Aug. 2, 2018

(30) Foreign Application Priority Data

Feb. 2, 2017 (KR) ..... 10-2017-0014802

(51) Int. Cl.

| | |
|---|---|
| ***A44B 11/18*** | (2006.01) |
| ***A44B 11/28*** | (2006.01) |
| ***A45F 3/04*** | (2006.01) |
| ***A45C 13/30*** | (2006.01) |
| *A45F 3/00* | (2006.01) |
| *A45F 5/10* | (2006.01) |
| *A45F 3/14* | (2006.01) |

(52) U.S. Cl.

CPC ..... *A44B 11/18* (2013.01); *A44B 11/28* (2013.01); *A45C 13/30* (2013.01); *A45F 3/047* (2013.01); *A45C 2013/306* (2013.01); *A45F 2003/001* (2013.01); *A45F 2003/142* (2013.01); *A45F 2005/1013* (2013.01); *Y10T 24/4093* (2015.01); *Y10T 24/4764* (2015.01)

(58) Field of Classification Search

CPC . Y10T 24/47; Y10T 24/2164; Y10T 24/2192; Y10T 24/4764; Y10T 24/4086; Y10T 24/4002; Y10T 24/4047; Y10T 24/4088; Y10T 24/4093

USPC ..... 54/85

See application file for complete search history.

(56) References Cited

U.S. PATENT DOCUMENTS 229,348 A * 6/1880 Witter ..... A44C 5/145 24/600.9
476,673 A * 6/1892 Nelson et al. ..... A41F 9/002 24/182
532,864 A * 1/1895 Brittain ..... A44C 5/14 24/265 R
571,689 A * 11/1896 Rozell ..... A41F 9/002 24/182
871,925 A * 11/1907 Gates ..... B68B 1/02 24/200

(Continued)

FOREIGN PATENT DOCUMENTS

KR 10-0737658 B1 2/2004

*Primary Examiner* — Robert Sandy
*Assistant Examiner* — Michael S Lee
(74) *Attorney, Agent, or Firm* — Novick, Kim & Lee, PLLC; Jae Youn Kim

(57) ABSTRACT

A strap connection member is disclosed. The strap connection member includes a pair of ring-shaped strap hangers provided at one side of a base and integrally formed so as to be spaced apart from each other. Therefore, the strap connection member may simply fix straps or connect straps such that the lengths of the straps are adjustable, and simultaneously connect two or more straps in different directions.

2 Claims, 19 Drawing Sheets

(56) References Cited

U.S. PATENT DOCUMENTS

| | | | | | |
|---|---|---|---|---|---|
| 881,462 | A * | 3/1908 | Craig | A44B 11/22 | 24/176 |
| 943,870 | A * | 12/1909 | Gelabert | A44C 5/14 | 24/182 |
| 3,686,711 | A * | 8/1972 | Kuramoto | A45C 13/30 | 16/445 |
| 4,020,985 | A * | 5/1977 | Halterman | A45B 1/04 | 2/315 |
| 5,839,171 | A * | 11/1998 | Tyrrell | B60R 22/18 | 24/265 BC |
| 6,212,688 | B1 * | 4/2001 | Leslie | A41D 19/0041 | 2/160 |
| 2003/0056338 | A1 * | 3/2003 | Anscher | A01K 27/005 | 24/71.1 |
| 2006/0225781 | A1 * | 10/2006 | Locher | H01L 31/02 | 136/245 |

* cited by examiner

STRAP CONNECTION MEMBER

BACKGROUND OF THE INVENTION

Field of the Invention

The present invention relates to a strap connection member which may effectively connect and disconnect straps installed on a backpack, a bag, clothing, a helmet, etc.

Description of the Related Art

In general, many appendages, such as buckles or rings, are mounted on a backpack, a bag, clothing, a helmet, etc., as needed. For example, many straps S are provided at various regions of a backpack for climbing, as exemplarily shown in FIG. 1, one end of each strap S is fixed to the backpack by sewing, various types of appendages, such buckles B, adjusters or rings, are installed at the straps S and used according to function, and buckles B to connect the straps S serving as a fixing belt are provided.

Further, during activity, such as camping or climbing, a large number of appendages, i.e., a lantern, a cup, a stick, a water bottle, etc., is received in or hung on a bag so as to be carried.

For this purpose, many straps and connection members, such as buckles or rings to connect and fix the straps are necessary.

In case of a large number of straps basically installed on a backpack, one end of each strap is fixed to the backpack by sewing, the other end of the strap hangs down so as to be connected to another strap or an appendage, a crossbar to connect the strap is formed at one side of each of various connection members to connect or adjust these straps, and an appendage having one of various shapes, such as a buckle, a ring or a hook having respective functions, is provided at the other side of each connection member.

As the most common example of connection members, there is a buckle which is mainly used to connect or disconnect two straps. The buckle includes a plug member and a socket member having female and male types so as to be combinable, a crossbar to connect and fix the strap is formed at the rear end of each of the plug member and the socket member, and a strap hooking bar is further provided at the rear end of any one of the plug member and the socket member in parallel with the crossbar so as to adjust the length of the connected strap.

Therefore, a connection member to simply connect and fix a strap is provided with one crossbar, and a connection member to adjust the length of a strap wound thereon is further provided with both a crossbar and a strap hooking bar formed in parallel, thus connecting the straps.

That is to say, a connection member to fix a strap is configured such that the strap is wound on a crossbar and then overlapping portions of the strap are sewn together, and a connection member to adjust the length of a strap connected thereto is configured such that the strap is wound on a strap hooking bar and is pressed by a crossbar so as to be fixed, and, in order to adjust the length of the strap, a pressed degree of the strap by the crossbar is decreased by lifting the connection member and thus the length of the strap is adjusted.

As described above, most connection members to connect straps are formed to have two types, one of which fixes a strap using a crossbar, and the other of which connects a strap through a double structure using a crossbar and a strap hooking bar.

Patent Document 1 discloses one example of connection members using straps, a plug member (a male member) and a socket member (a female member) are provided so as to be combinable, and straps are connected to rear ends of the plug member and the socket member through slots formed by crossbars formed at the rear ends.

Patent Document 1 describes one example of a typical buckle in which a connection member provided with a crossbar alone fixes a strap by sewing, etc., and a connection member provided with both a crossbar and a strap hooking bar adjusts the length of a strap connected thereto.

However, the above-described strap connection structure has problems, as below.

First, structures of connection members vary according to purposes of connecting straps, i.e., fixation of a strap and adjustment of the length of a strap, and thus there is no product compatibility.

Due to lack of product compatibility, all products should be separately manufactured according to functions and be differently sorted, managed and handled, thus lowering productivity and causing rise in manufacturing costs and rise in distribution costs.

Moreover, a conventional strap connection member is configured so as to connect one strap in only one direction.

Connection of straps is used to connect necessary appendages, to hang necessary appendages or to support necessary positions of appendages, and, as needed, is used to simultaneously connect several straps, or to connect straps in several directions, and the conventional connection member cannot achieve such connection.

Therefore, in order to achieve the several functions described above, a larger number of straps and a larger number of connection members to connect the straps should be used and, thereby, usage of the straps may be very inconvenient and appearance of a backpack provided with these straps may be poor.

PRIOR ART DOCUMENT

Patent Document

1. Korean Patent Registration No. 10-0737658 (Jul. 3, 2007)

SUMMARY OF THE INVENTION

Therefore, the present invention has been made in view of the above problems, and it is an object of the present invention to provide a strap connection member which allows a strap installed on a backpack or a bag to be fixed to a position of the strap connection member or to be connected to a position of the strap connection member such that the length of the strap is adjustable.

It is another object of the present invention to provide a strap connection member which allows two or more straps to be connected to a position of the strap connection member such that the directions of the connected straps may be arbitrarily set.

In accordance with the present invention, the above and other objects can be accomplished by the provision of a strap connection member including a pair of ring-shaped strap hangers provided at one side of a base and integrally formed so as to be spaced apart from each other.

The corners of the outer parts of the strap hangers may be curved.

A slit formed by the strap hangers spaced apart from each other may have a tilt angle so as to gradually expand from the base.

Opposite surfaces of the front ends of the strap hangers may be outwardly inclined.

The strap hangers may have different protruding lengths from the base.

The strap hangers may have an arc shape or a polygonal shape.

The strap hangers may have different shapes, and ring parts formed by the strap hangers may be alternated with each other.

A strap appendage may be formed at the other side of the base.

The strap appendage may be a plug member or a socket member of a buckle, and the buckle may be used in a bag, a backpack or clothing.

The strap appendage and the strap hangers may form a ring so that various accessories may be connected thereto.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Reference will now be made in detail to the preferred embodiments of the present invention, examples of which are illustrated in the accompanying drawings.

Figure 1:
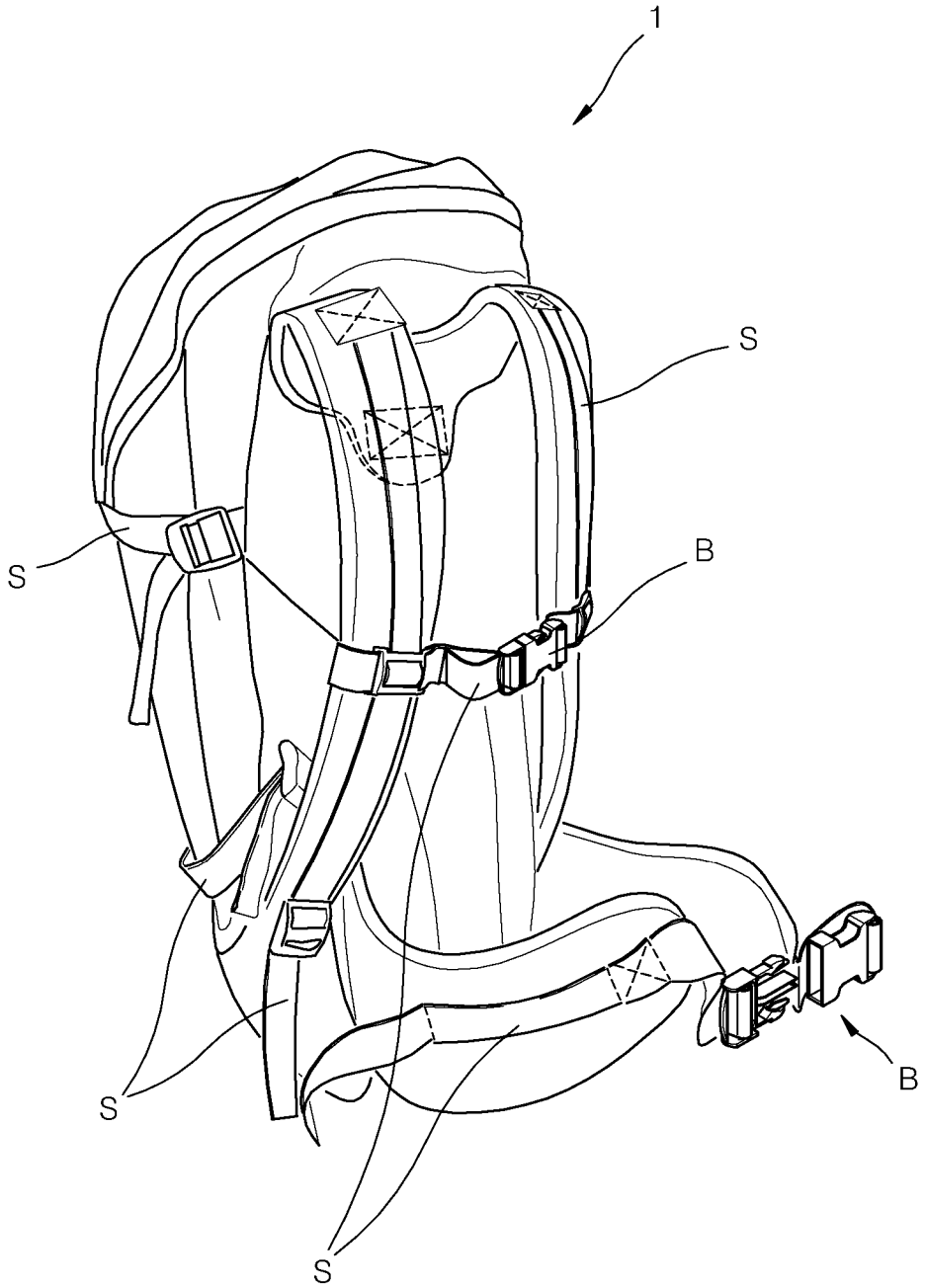
FIG. 1 PRIOR ART
FIG. 1 is a perspective view exemplarily illustrating a general backpack.
Figure 2:
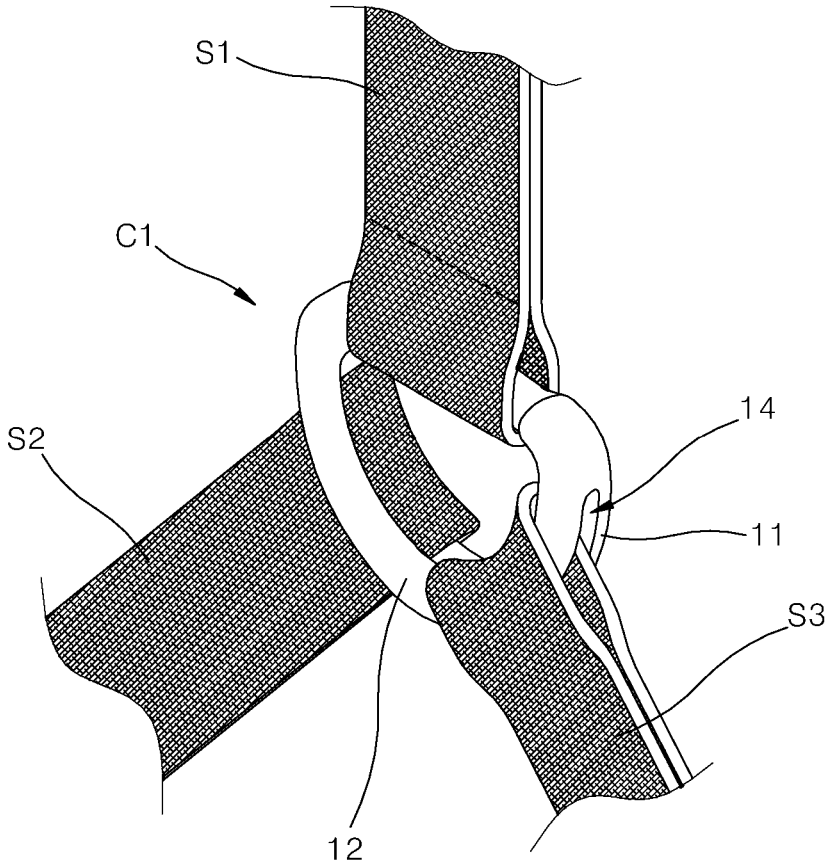
FIG. 2 is a perspective view of a strap connection member in accordance with one embodiment of the present invention.
Figure 3:
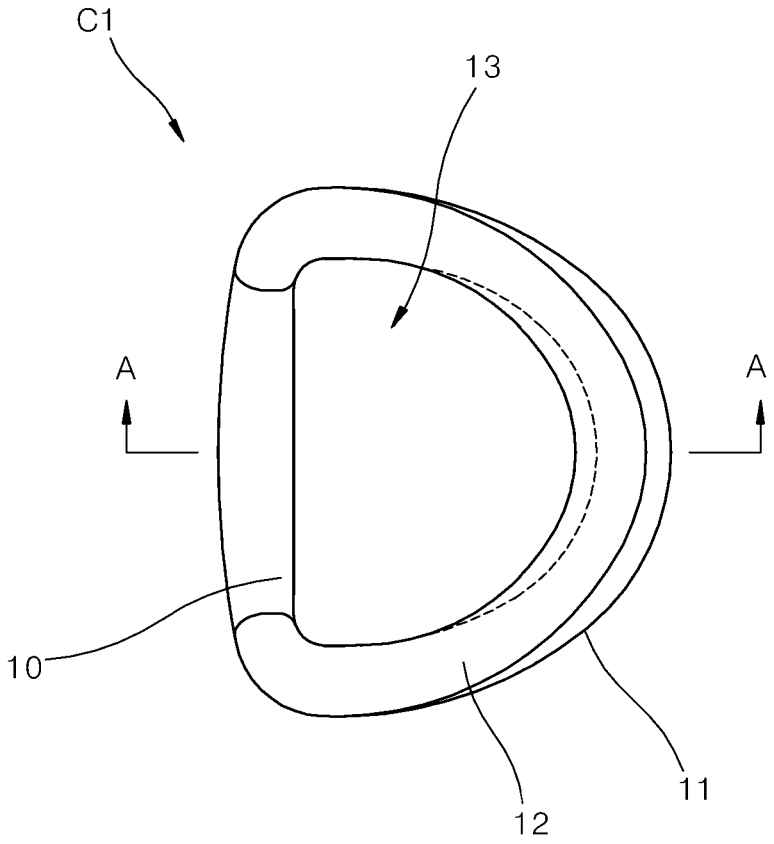
FIG. 3 is a plan view of FIG. 2.
Figure 4:
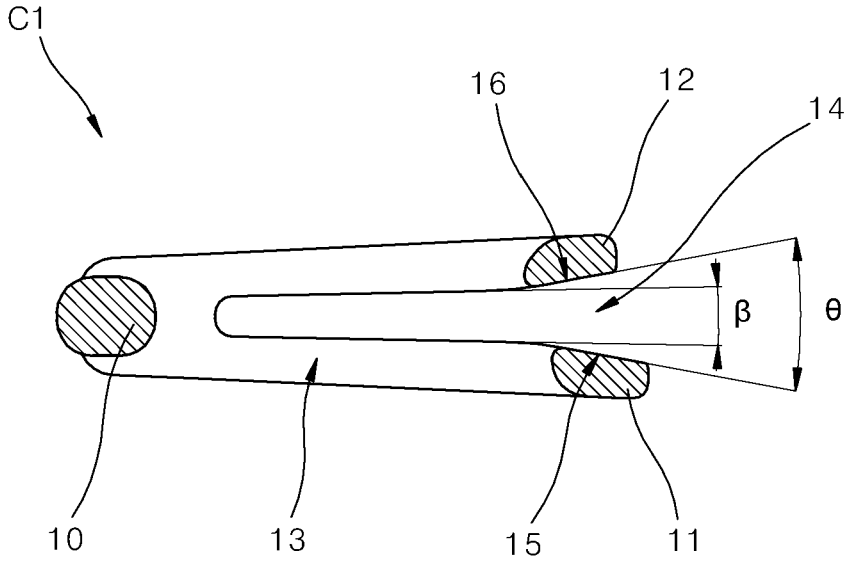
FIG. 4 is a cross-sectional view taken along line A-A of FIG. 3.

FIG. 2 is a perspective view of a strap connection member in accordance with one embodiment of the present invention, FIG. 3 is a plan view of FIG. 2, and FIG. 4 is a cross-sectional view taken along line A-A of FIG. 3. As exemplarily shown in FIGS. 2 to 4, a connection member C1 in accordance with the present invention includes a pair of strap hangers integrally formed as rings spaced apart from each other and provided at one side of a base 10.

Hereinafter, the pair of strap hangers basically includes a first strap hanger 11 and a second strap hanger 12.

In FIGS. 2 to 4, a D ring, which connects straps installed on a backpack or a bag, is applied as the connection member C1 and, among many connection members, the D ring has a simple configuration.

The base 10 of the connection member C1 serves as a bar on which a strap is wound so as to be connected and fixed to the connection member C1, and the first strap hanger 11 and the second strap hanger 12 having a ring shape are formed at one side of the base 10 and thus form a ring part 13.

The first strap hanger 11 and the second strap hanger 12 having the same shape are opposite each other and are formed integrally with the base 10, thus forming the ring part 13. The first strap hanger 11 and the second strap hanger 12 are spaced apart from each other and, thus, a slit 14 is formed between the first strap hanger 11 and the second strap hanger 12.

The opposite surfaces of the first strap hanger 11 and the second strap hanger 12 may be flat and the corners of the outer parts connected to the opposite surfaces of the first strap hanger 11 and the second strap hanger 12 may be curved and, in this case, it is favorable to wind straps on the first strap hanger 11 and the second strap hanger 12 so as to fix the straps.

The first strap hanger 11 and the second strap hanger 12 are spaced apart from the base 10 and extend in parallel in the same direction while forming the slit 14 between the first strap hanger 11 and the second strap hanger 12, and, particularly, the first strap hanger 11 and the second strap hanger 12 form a designated slit tilt angle $\beta$ from the base 10 so that the slit 14 gradually expands from the base 14.

Therefore, straps may more easily enter the connection member C1 through the slit 14 having an inlet having a large width in the opposite direction of the base 10.

Further, opposite surfaces 15 and 16 of the front ends of the first strap hanger 11 and the second strap hanger 12 may be outwardly inclined and thus form an inlet tilt angle $\theta$, which is greater than the slit tilt angle $\beta$, at the inlet of the slit 14 formed by the front ends of the respective strap hangers 11 and 12, thereby allowing straps to more easily enter the slit 14.

Of course, values of the slit tilt angle $\beta$ and the inlet tilt angle $\theta$ may be arbitrarily selected, as needed, and vary according to applied straps or connection members.

A pair of the first and second strap hangers 11 and 12 in accordance with the present invention may have different protruding lengths and, as exemplarily shown in FIGS. 2 to 4, the first strap hanger 11 protrudes to a greater length than the second strap hanger 12.

If the first strap hanger 11 and the second strap hanger have different protruding lengths, it may be easier to insert a strap into the slit 14 and then to wind the strap.

That is, if a strap passes through the ring part 13 from the outside of the first strap hanger 11 having a greater length, enters the slit 14 and then winds the first strap hanger 11 so that the length of the strap is adjustable, the inlet of the slit 14 becomes wider due to a difference in protruding lengths between the front ends of the respective strap hangers 11 and 12 and the strap having passed through the ring part 13 is easily inserted into the slit 14.

Further, in order to adjust the length of the strap, when the first strap hanger 11 having a greater length is slightly lifted up so that the pressed degree of the strap is reduced, the first strap hanger 11 is conveniently lifted up.

Figure 5:
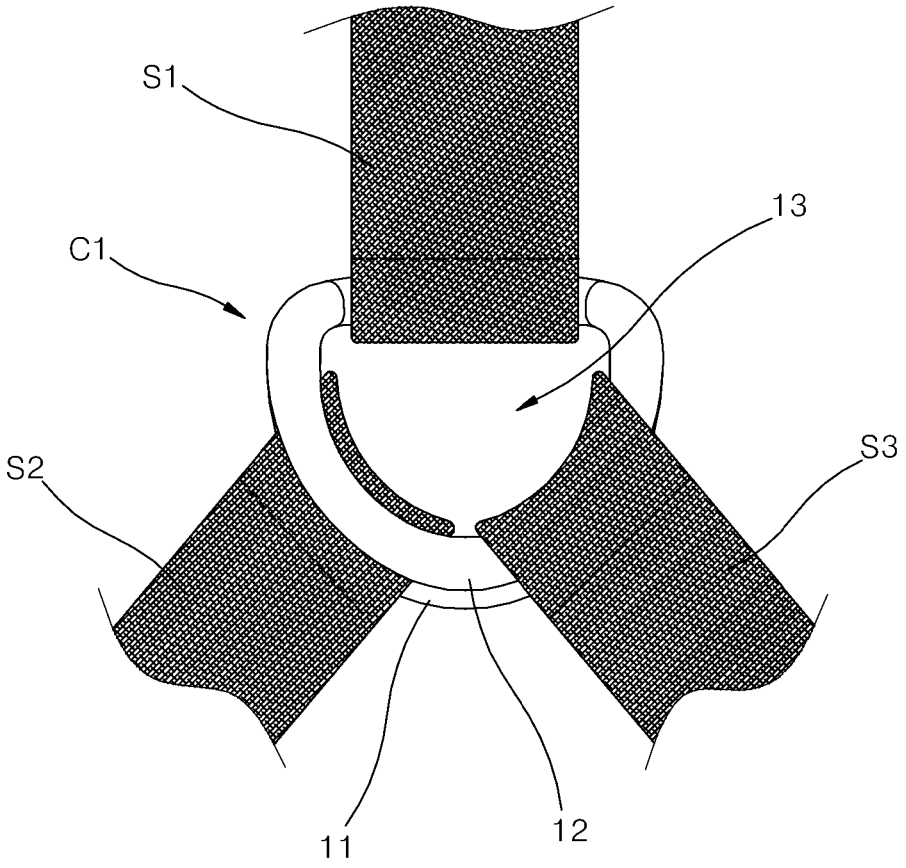
FIG. 5 is a view of the strap connection member of FIG. 3 in a way in which straps are connected to the strap connection member.
Figure 6:
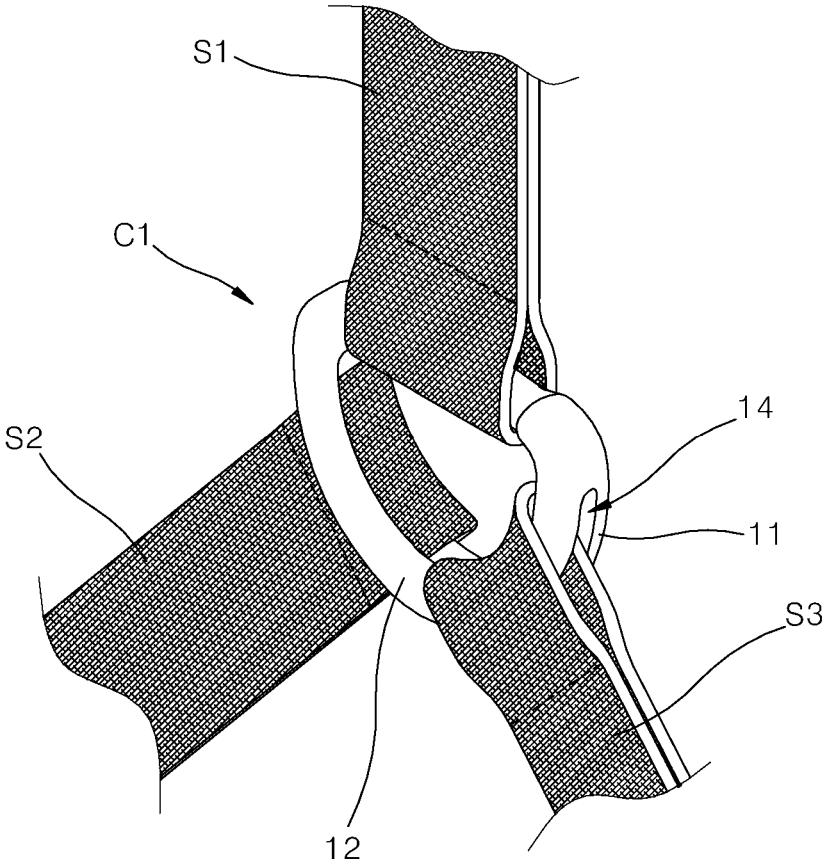
FIG. 6 is a perspective view of FIG. 5.
Figure 7:
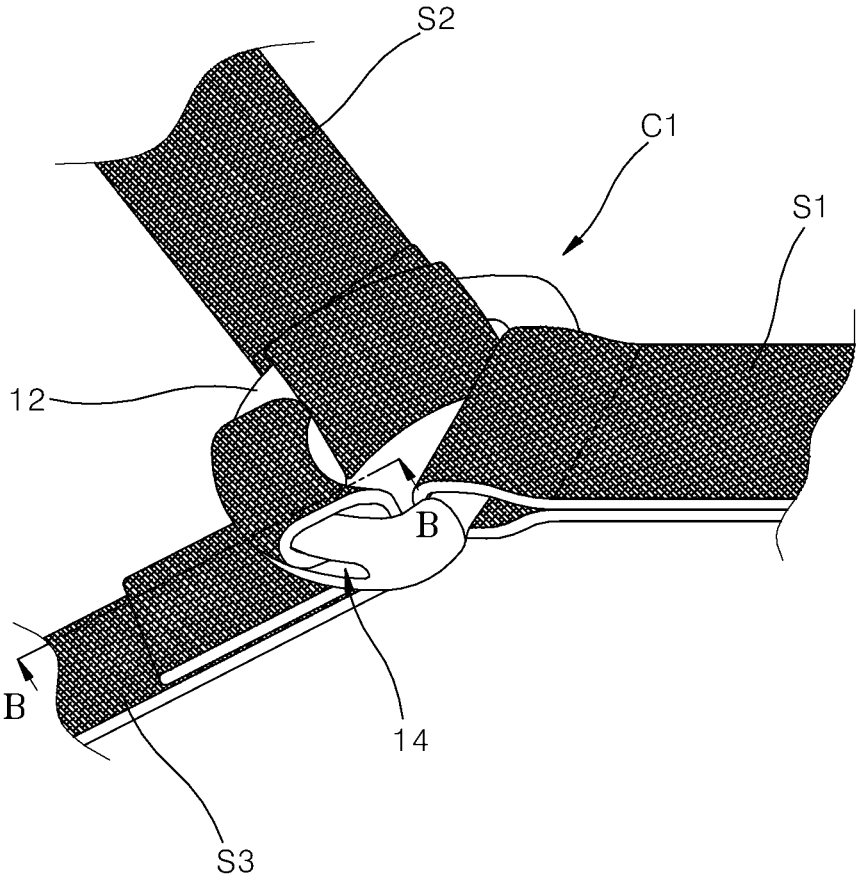
FIG. 7 is a perspective view of the strap connection member of FIG. 3 in another way in which straps are connected to the strap connection member.

FIGS. 5 to 7 are views respectively exemplarily illustrating a connection member C1 to which strap are connected. In FIGS. 5 and 6, a strap S1 provided in one direction is wound on a bar forming a base 10 of the connection member C1 formed by a D ring and is fixed by sewing, and different straps S2 and S3 are wound on a first strap hanger 11 and a second strap hanger 12.

Therefore, FIGS. 5 and 6 illustrate that the straps S1, S2 and S3 are connected to the connection member C1 in three directions. If straps are fixed simply by winding, as such, the straps may be wound on any one of a pair of strap hangers or be wound on both the strap hangers.

Further, in FIG. 7, a strap S1 provided in one direction is wound on a bar forming the base 10 of the connection member C1 and is fixed by sewing, and two straps S2 and S3 provided in different directions are wound on the first strap hanger 11 and the second strap hanger 12 such that the lengths of the straps S2 and S3 are adjustable.

Here, a strap may be wound on any one of the two strap hangers 11 and 12 so as to be fixed, and thereby another type of connection may be carried out. As such, one of various arbitrary types of connection may be selected, as needed.

Figure 8:
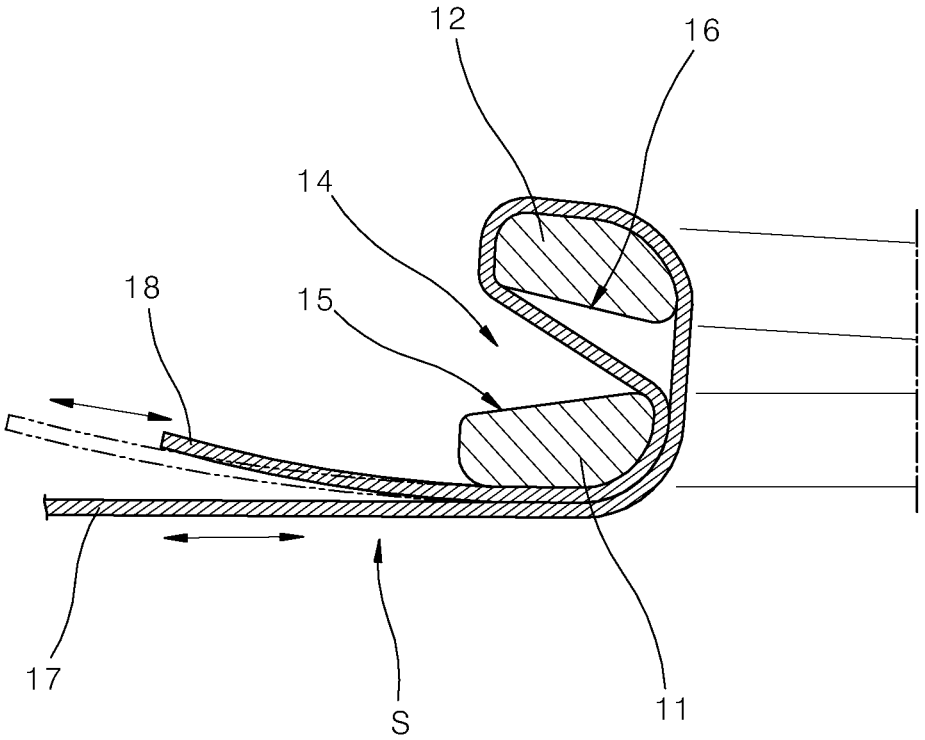
FIG. 8 is a cross-sectional view taken along line B-B of FIG. 7.

FIG. 8 is a cross-sectional view taken along line B-B of FIG. 7, illustrating a detailed structure of connecting a strap S to the strap hangers 11 and 12 so that the length of the strap S is adjustable. With reference to FIG. 8, a free end 18 of the strap S passes through a ring part 13 from the outside of the first strap hanger 11, is wound on the second strap hanger 12, is inserted into the slit 14 from the front end of the second strap hanger 12, overlaps a fixed end 17 of the strap S, is wound on the inner part of the first strap hanger 11, and is withdrawn to the front end of the first strap hanger 11.

Thereby, the strap S is substantially wound on the second strap hanger 12 and the free end 18 and the fixed end 17 of the strap S overlap each other on the first strap hanger 11 and is pressed by the first strap hanger 11 so as to maintain the connection state of the strap S to the connection member C1, and the strap S is bent at the corner of the front end of the second strap hanger 12 and the corner of the rear end of the first strap hanger 11 so as to maintain the fixed state of the strap S.

Therefore, relations, such as a distance and an interval between the front end of the second strap hanger 12 and the rear end of the first strap hanger 11, etc., are important in connecting a strap to the connection member C1 and may thus be adjusted, as needed.

In order to adjust the length of the strap S connected to the connection member C1, the strap S is drawn or released by lifting up the first strap hanger 11 while holding the free end 18 of the strap S. When the first strap hanger 11 is lifted up, the strap S pressed by the first strap hanger 11 is released and thus easily drawn.

Figure 9:
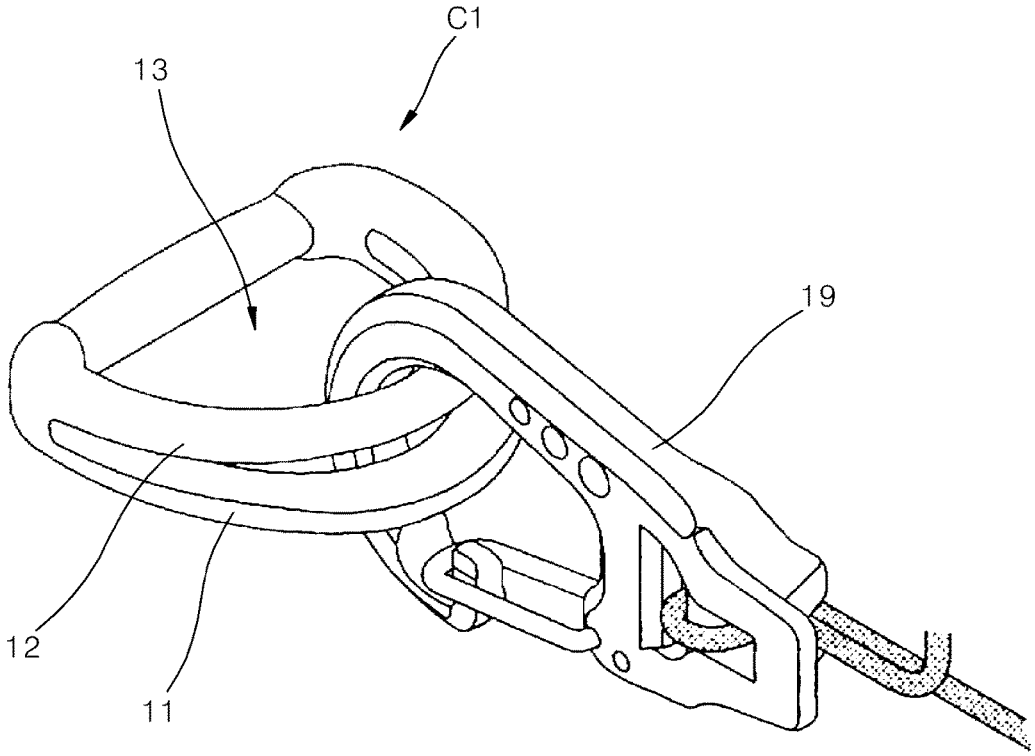
FIG. 9 is a perspective view illustrating another state of using the strap connection member in accordance with the present invention.

Further, other members than straps may be connected to the connection member C1 of the present invention. For example, a hook 19 may be hung on the strap hangers 11 and 12 so as to be connected to the strap hangers 11 and 12, as exemplarily shown in FIG. 9.

Figure 10:
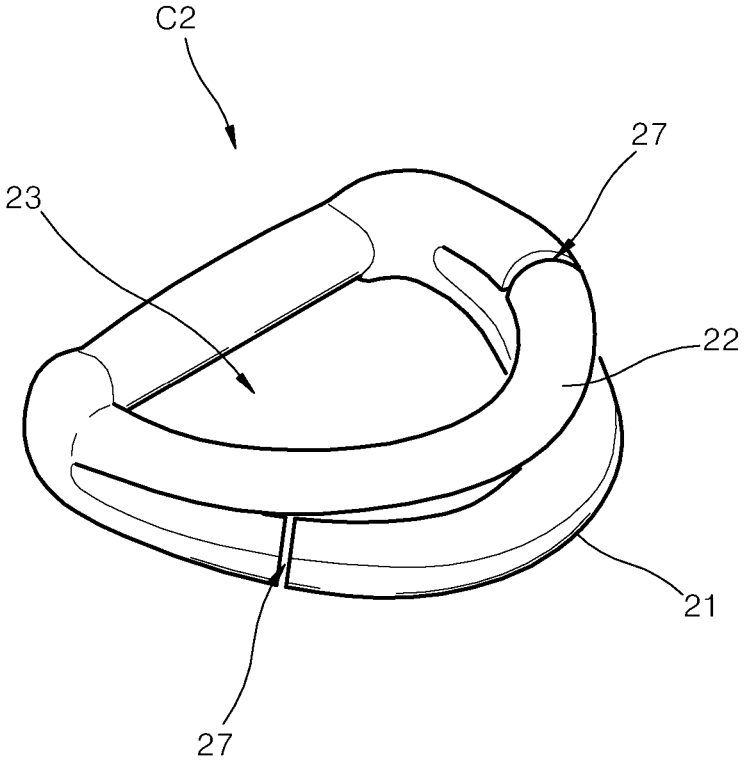
FIG. 10 is a perspective view of strap hangers in accordance with another embodiment of the present invention.

FIG. 10 is a perspective view of a connection member in accordance with another embodiment of the present invention. With reference to FIG. 10, a connection member C2 includes a pair of strap hangers 21 and 22 extending from a base 20 in one direction and simultaneously forming a ring part 23, and a cut part 27 is formed at one end of each of the first strap hanger 21 and the second strap hanger 22.

If insertion a free end of a strap into the ring part 23 is difficult, the strap may be connected to the connection member C2 by inserting a mid-portion of the strap into the cut part 27. Such a cut part 27 may be applied to the strap hanger in accordance with the present invention.

The cut parts 27 may be formed at alternate positions of the pair of strap hangers 21 and 22, thus preventing the strap from being easily separated from the connection member C2.

Figure 11:
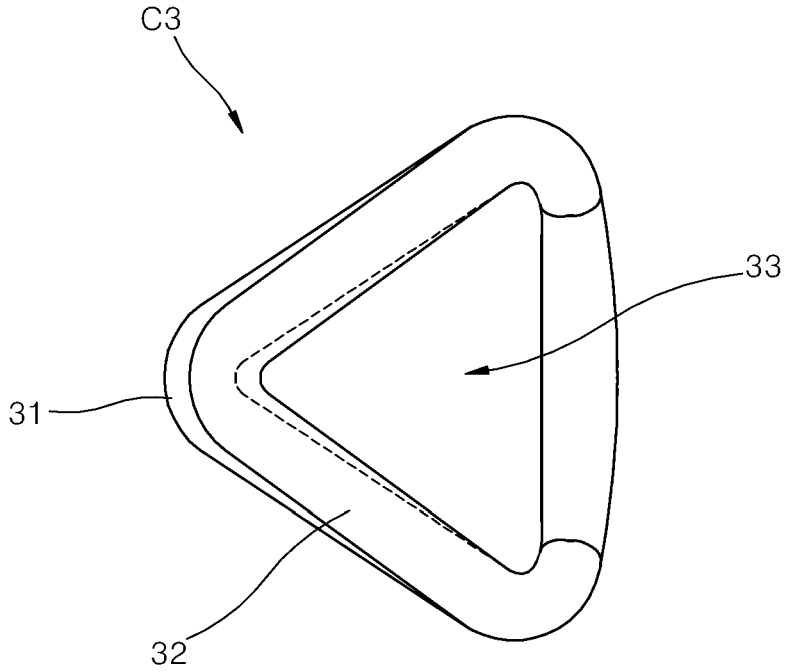
FIG. 11 is a plan view of strap hangers in accordance with yet another embodiment of the present invention.
Figure 12:
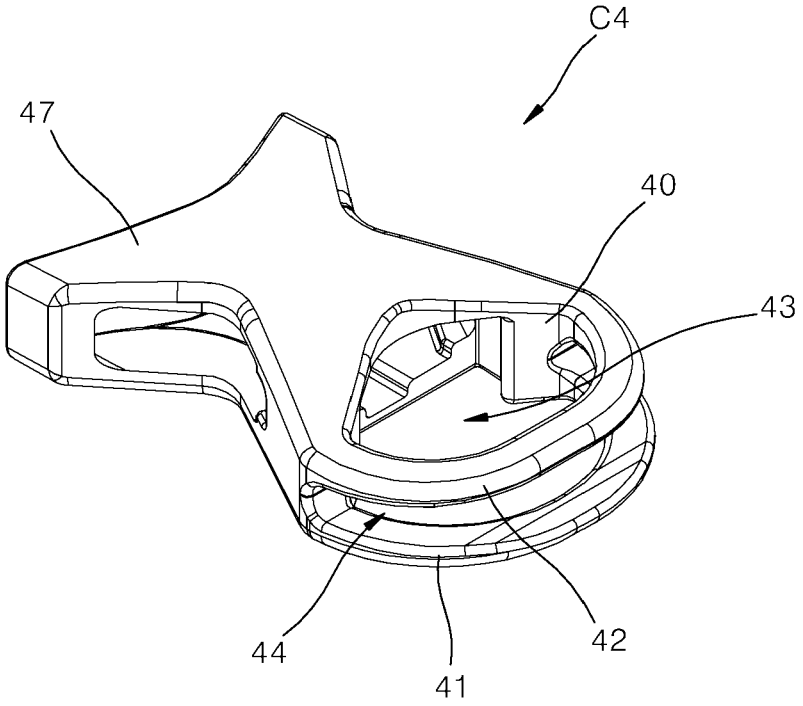
FIG. 12 is a perspective view exemplarily illustrating a socket member of a buckle, to which the present invention is applied.
Figure 13:
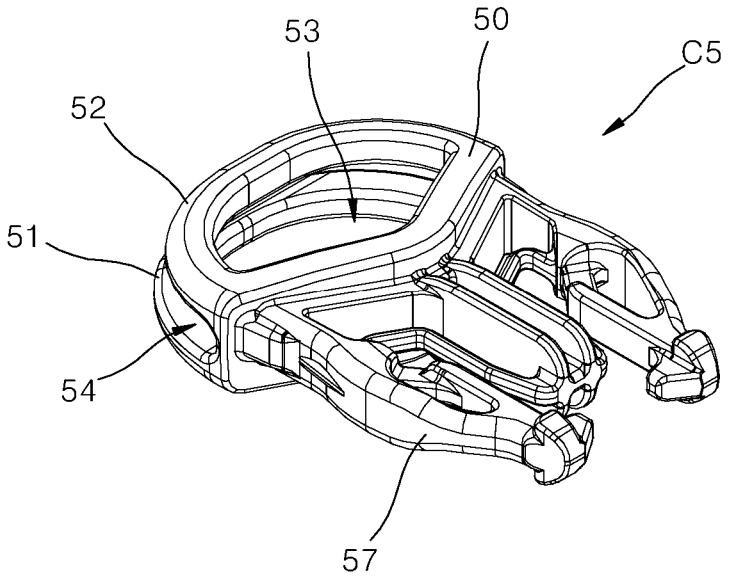
FIG. 13 is a perspective view exemplarily illustrating a plug member of the buckle, to which the present invention is applied.
Figure 14:
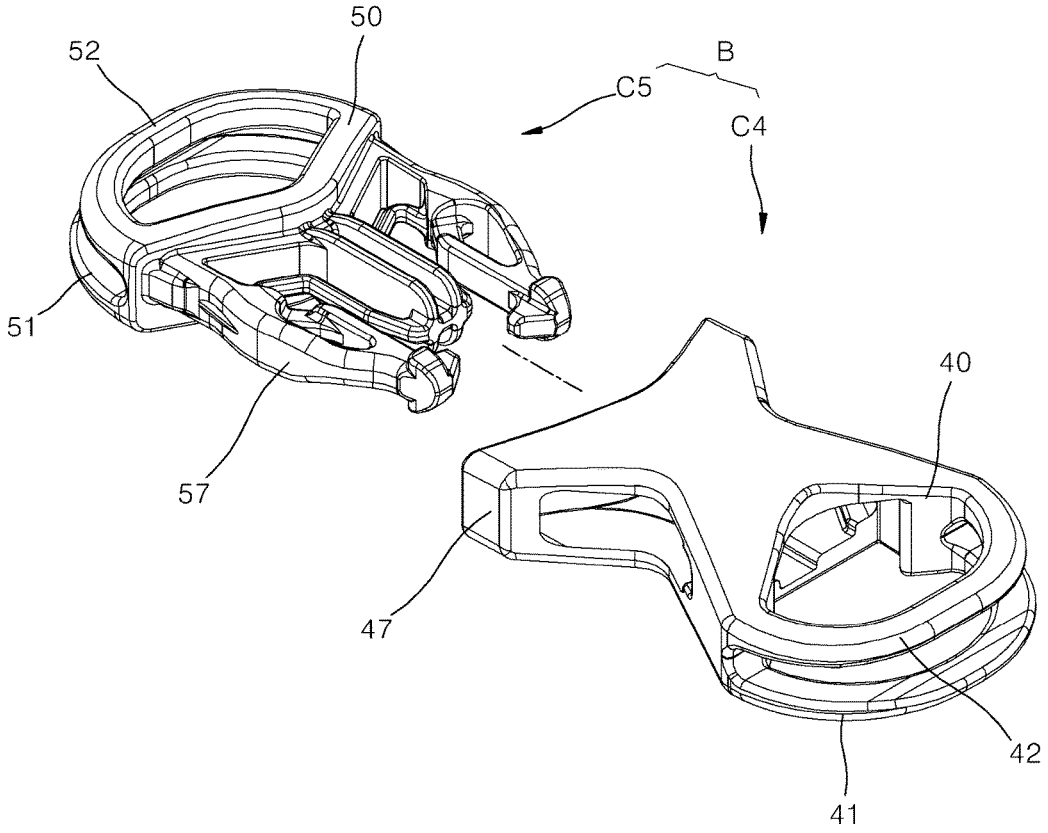
FIGS. 14 and 15 are perspective views illustrating the buckle shown in FIGS. 12 and 13 in a separated state or in a coupled state.
Figure 15:
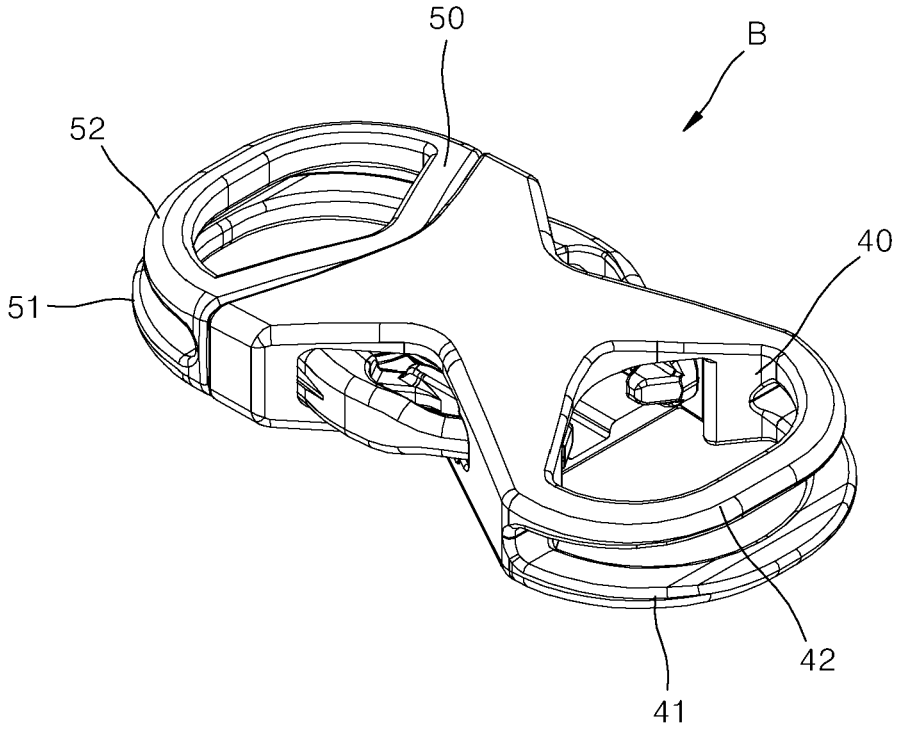

Further, a strap hanger of a strap connection member in accordance with the present invention may have other shapes than an arc shape. That is, a pair of strap hangers 31 and 32 extending from a base 30 of a connection member C3 may have a triangular shape forming a ring part 33 provided therein, as exemplarily shown in FIG. 11, or may have other shapes, such as a rectangular shape, a diamond shape and an oval shape.

If strap hangers have a polygonal shape, directionality of straps connected thereto may be specified.

FIGS. 12 to 19 are views illustrating various strap appendages applied to a connection member in accordance with the present invention and, particularly, FIGS. 12 to 15 illustrate a buckle B including a socket and a plug, which are detachably attached to each other.

That is, a socket connection member C4 includes a socket 47 formed at one side of a base 40, a pair of strap hangers 41 and 42, which are spaced apart from each other, formed at the other side of the base 40 and forming a ring part 43 provided therein, and a slit 44 formed between the strap hangers 41 and 42 so that a strap may be connected to the strap hangers 41 and 42, and a plug connection member C5 includes a plug 57 formed at one side of a base 50, a pair of strap hangers 51 and 52, which are spaced apart from each other, formed at the other side of the base 50 and forming a ring part 53 provided therein, and a slit 54 formed between the strap hangers 51 and 52 so that a strap may be connected to the strap hangers 51 and 52. The socket connection member C4 and the plug connection member C5 are provided in a set and thus form the buckle B.

Here, the illustrated buckle B is only one type of a large number of buckles, and various sockets and plugs may be employed.

Further, as exemplarily shown in FIGS. 12 to 15, the bases 40 and 50 serving as boundaries between strap hangers in accordance with the present invention and appendages may have a rectilinear shape or a curved shape and include a minimum connection portion which may support the strap hangers.

Figure 16:
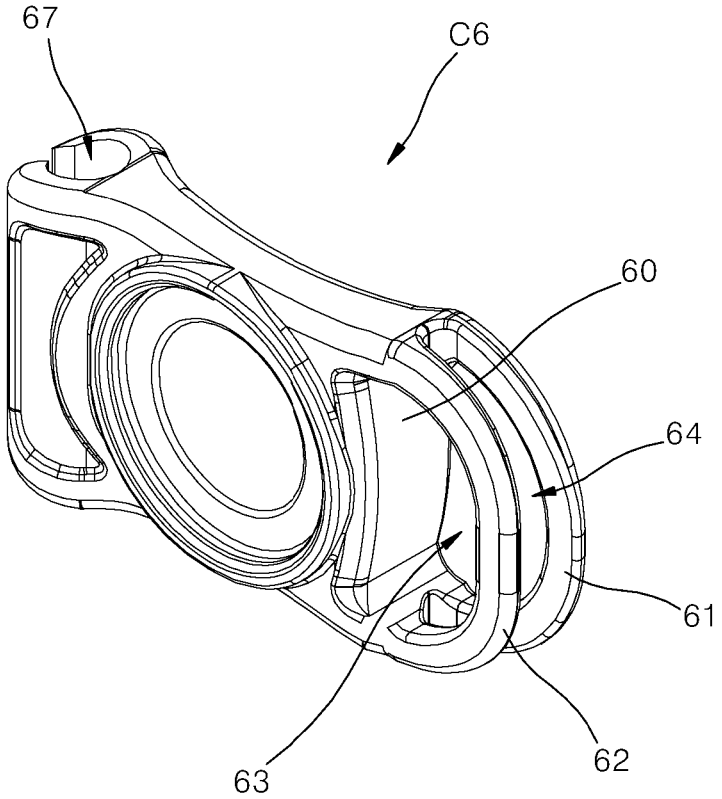
FIGS. 16 to 19 are views illustrating connection members, to which strap hangers in accordance with the present invention are applied.

FIG. 16 is a view illustrating example in which a connection member in accordance with the present invention is applied to a lifting buckle. That is, FIG. 16 illustrates a lifting buckle connection member C6 including a rail groove 67 for combination with a lifting rail, formed at one side of a base 60, a pair of strap hangers 61 and 62, which are spaced apart from each other, formed at the other side of the base 60 and forming a ring part 63 provided therein, and a slit 64 formed between the strap hangers 61 and 62 so that a strap may be connected to the strap hangers 61 and 62.

Figure 17:
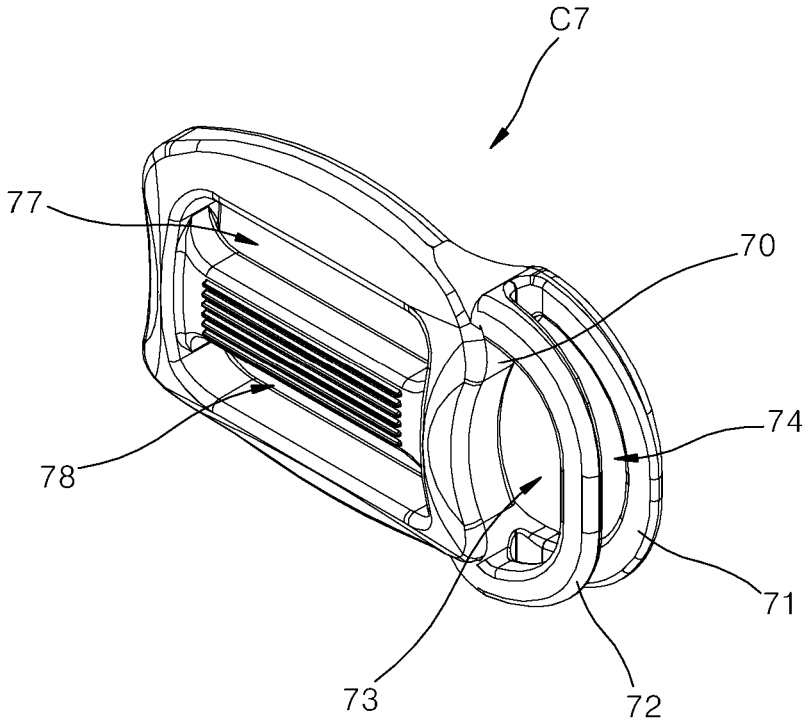

FIG. 17 is a view illustrating example in which a connection member in accordance with the present invention is applied to a strap adjuster. That is, FIG. 17 illustrates an adjuster connection member C7 including slots 77 and 78 formed at one side of a base 70 so that a strap may be continuously inserted into the slots 77 and 78, a pair of strap hangers 71 and 72, which are spaced apart from each other, formed at the other side of the base 70 and forming a ring part 73 provided therein, and a slit 74 formed between the strap hangers 71 and 72 so that a strap may be connected to the strap hangers 71 and in a different direction from the strap inserted into the slots 77 and 78.

Figure 18:
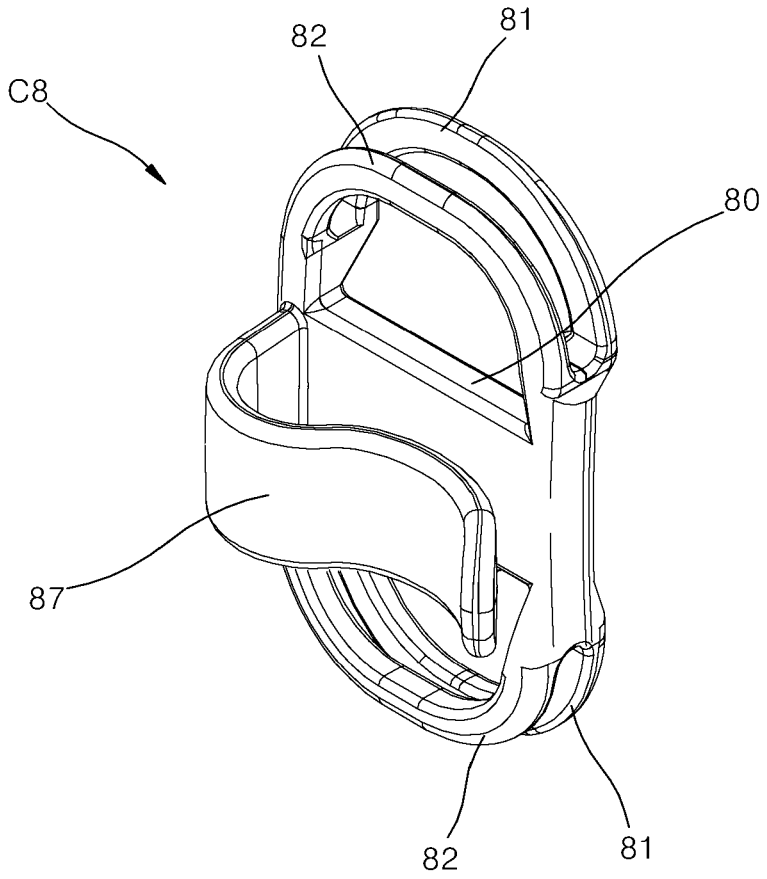

FIG. 18 is a view illustrating example in which a connection member in accordance with the present invention is applied to a clip. That is, FIG. 18 illustrates a clip connection member C8 including a pair of strap hangers 81 and 82, which are spaced apart from each other, formed at each of both sides of a base 80 provided with a clip 87 formed at one end thereof so that straps may be connected to two pairs of strap hangers 81 and 82 formed at both sides of the base 80.

Figure 19:
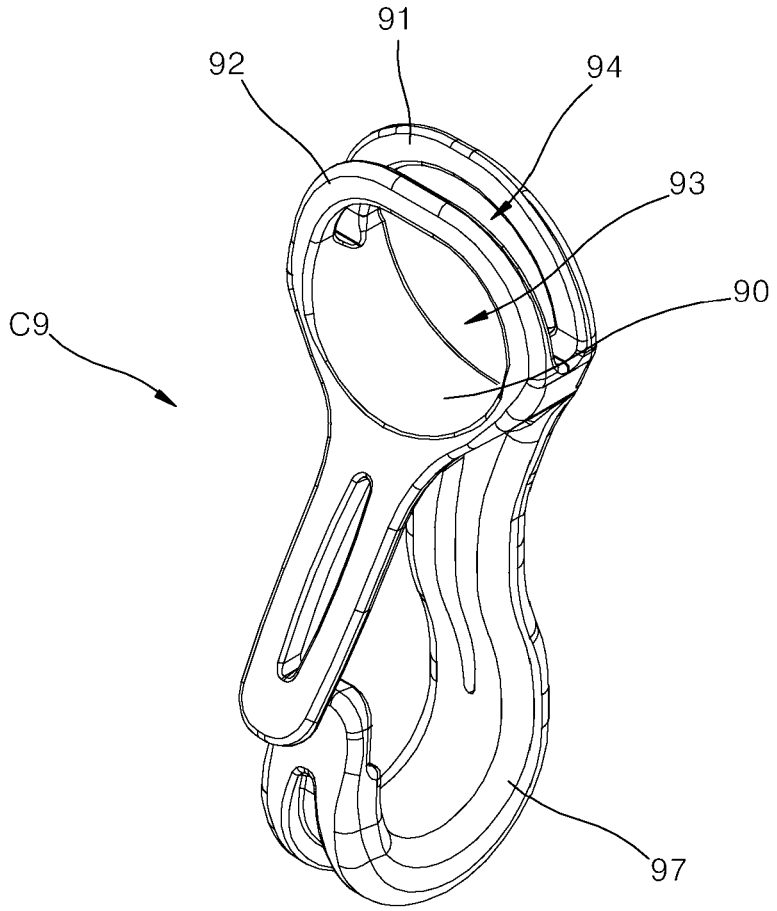

FIG. 19 is a view illustrating example in which a connection member in accordance with the present invention is applied to a hook. That is, FIG. 19 illustrates a hook connection member C9 including a hook 97 formed at one side of a base 90, a pair of strap hangers 91 and 92, which are spaced apart from each other, formed at the other side of the base 90 and forming a ring part 93 provided therein, and a slit 94 formed between the strap hangers 91 and 92 so that one strap or two or more straps may be connected to the strap hangers 91 and 92.

As apparent from the above description, a strap connection member in accordance with the present invention includes a pair of strap hangers formed in one direction so that the strap hangers may be used as one strap hanger or be used as separate strap hangers, thus providing convenience.

Further, the strap connection member in accordance with the present invention allows different straps to be connected to a pair of the strap hangers, thereby allowing simultaneous connection of the straps in several directions.

Further, the strap connection member in accordance with the present invention may arbitrarily select a connection type, i.e., simple connection and fixation of a strap or adjustment of the length of a connected strap.

Moreover, in the strap connection member in accordance with the present invention, the direction of a strap connected thereto may be arbitrarily moved, thus allowing the strap to be connected in an arbitrary direction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, a connection member in accordance with the present invention may be formed of various materials, such as a synthetic resin, a metal, etc., be changed in surface or shape, and have elasticity.

Further, straps applied to the present invention may include various types, such as a string, a rope, a bend, a belt for connection, etc.

What is claimed is:

1. A strap connection member comprising:

a base;

a first ring-shaped strap hanger integrally connected to the base; and a second ring-shaped strap hanger integrally connected to the base, the second ring-shaped strap hanger being spaced apart from the first ring-shaped strap, wherein a slit disposed between the first and second ring-shaped strap hangers spaced apart from each other has a tilt angle gradually expanding from the base, wherein the first and second ring-shaped strap hangers have different lengths from each other and protrude from the base.

2. A strap connection member comprising:

a base;

a first ring-shaped strap hanger integrally connected to the base; and a second ring-shaped strap hanger integrally connected to the base, the second ring-shaped strap hanger being spaced apart from the first ring-shaped strap, wherein a slit disposed between the first and second ring-shaped strap hangers spaced apart from each other has a tilt angle gradually expanding from the base, wherein the first and second ring-shaped strap hangers have different shapes from each other.

* * * * *